US006920909B2

(12) United States Patent
Colon et al.

(10) Patent No.: US 6,920,909 B2
(45) Date of Patent: Jul. 26, 2005

(54) CORE ASSEMBLY APPARATUS AND PROCESS FOR ASSEMBLY OF IN-LINE SIX CYLINDER CORE PACKAGES

(75) Inventors: Christopher J. Colon, Noblesville, IN (US); James E. Thixton, Jr., Greenfield, IN (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/691,397

(22) Filed: Oct. 22, 2003

(65) Prior Publication Data

US 2005/0087322 A1 Apr. 28, 2005

(51) Int. Cl.[7] ..... B22D 33/00; B22D 5/02
(52) U.S. Cl. ..... 164/339; 164/323; 164/326
(58) Field of Search ..... 164/339, 137, 164/322–331

(56) References Cited

U.S. PATENT DOCUMENTS 3,063,106 A * 11/1962 Peirce ..... 164/339
3,627,028 A * 12/1971 Carignan ..... 164/323
3,741,281 A * 6/1973 Hauser-Lienhard ..... 164/253
4,221,258 A * 9/1980 Richard ..... 164/181
5,088,608 A * 2/1992 Grum-Schwensen ..... 211/70.6
6,725,903 B2 * 4/2004 Laurino ..... 164/323

* cited by examiner

*Primary Examiner*—Kevin P. Kerns
(74) *Attorney, Agent, or Firm*—Dennis Kelly Sullivan; Susan L. Lukasik; Jeffrey P. Calfa

(57) ABSTRACT

A core assembly apparatus includes a rotating table having a plurality of operation positions. A plurality of fixtures for assembling cores are carried by the rotating table adjacent its periphery, preferably one core assembly fixture for each operation position. The core assembly fixtures are inclined toward the central portion of the rotating table. In one of the operation positions, a completed core assembly is transferred from a core assembly fixture to a horizontal conveyor. A pick-and-place assembly engages a core assembly and removes it from an inclined core assembly fixture of a rotating table and placement on a horizontal conveyor. Alternatively, the fixtures may be pivotally attached to the rotating table and include core assembly gripping mechanisms so that the core assembly fixtures can pivot to lower assembled cores onto a horizontal conveyor.

10 Claims, 5 Drawing Sheets

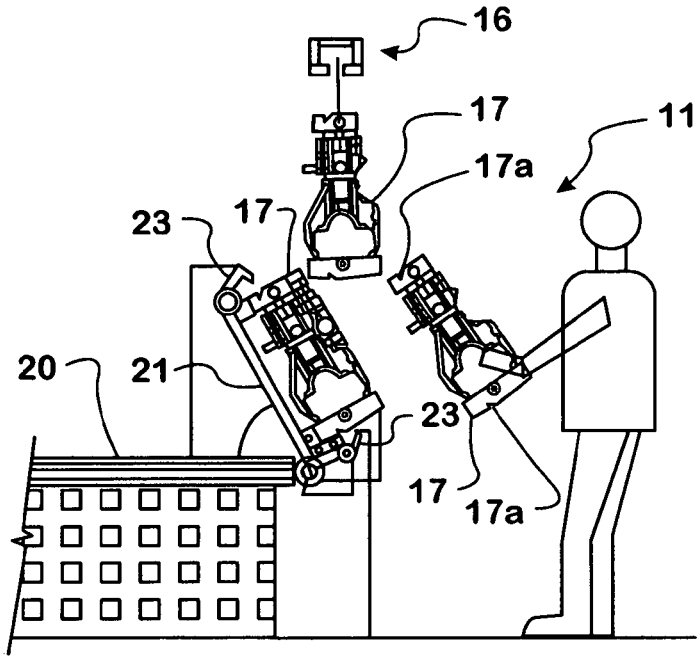
FIG. 2
FIG. 3
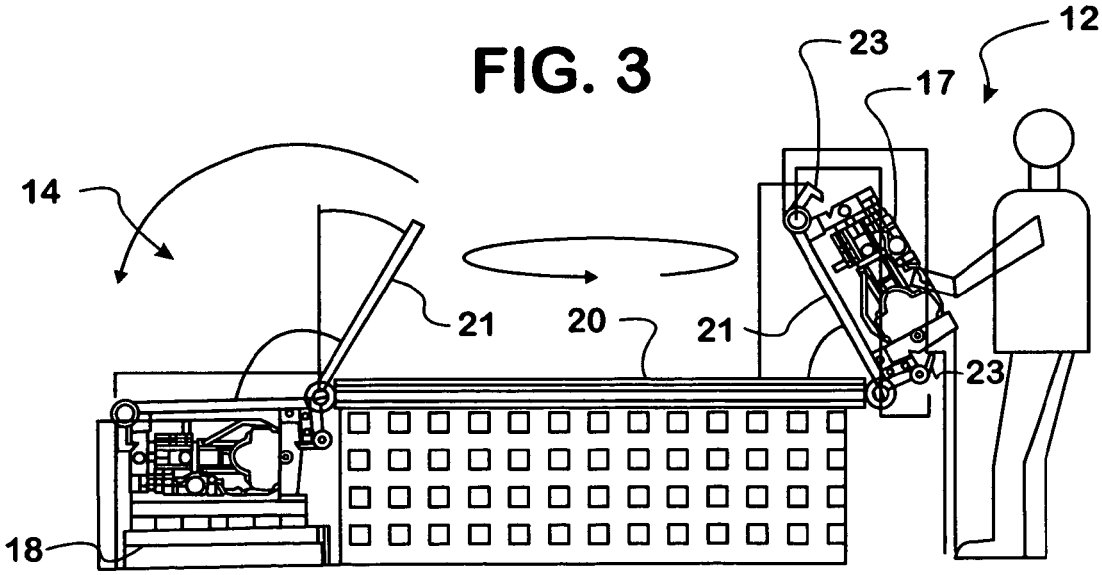

CORE ASSEMBLY APPARATUS AND PROCESS FOR ASSEMBLY OF IN-LINE SIX CYLINDER CORE PACKAGES

FIELD OF THE INVENTION

This invention relates to core assembly apparatus and processes for the assembly of cores for casting internal combustion engine parts and, more particularly, to core assembly apparatus and processes for the assembly of cores for the manufacture of in-line six cylinder internal combustion engines.

BACKGROUND OF THE INVENTION

In the manufacture of in-line six cylinder internal combustion engines, cores have been lifted manually from delivery hooks by a rotating crew of three people, two of which must walk back and forth from the delivery rail system to an assembly fixture. In the assembly of the cores, two people, one person at each end of a core, standing on opposite sites of a horizontal fixture, must reach out beyond their center of gravity to place each core, which weighs approximately 55–64 lbs., into a core assembly fixture. The assembled cores, as a unit, are then mechanically raised out of the core assembly fixture and manually rolled on a horizontal track conveyor to a second station where the cores are bolted together by two additional people. The bolted core assemblies are then lowered onto storage boards on a horizontal conveyor and manually rolled out of the assembly area onto a storage elevator.

More specifically, in a typical core assembly operation for the assembly of cores for the manufacturing of in-line six cylinder internal combustion engines, cores are taken from an overhead conveyor that carries the cores in an L-shaped path adjacent a large horizontal table on which the cores are assembled. One man stationed at the side of the long horizontal table that is not adjacent the conveyor line takes tappet cores off a conveyor line and places them into a core assembly fixture. Two men place the barrels for formation of the engine cylinders into the fixture in numerical order. The second man working in this core assembly area takes the barrels for cylinders one, three and five off an overhead conveyor and places them into the core assembly fixture. The third man working in this area takes the barrels for cylinders two, four and six off the overhead conveyor and places them in the core assembly fixture. The barrels must be accurately seated on the locating surfaces of the core assembly fixture, and since each barrel weighs about 55–64 lbs., the first man helps the second and third men lower their barrels into the fixture and lowers the head face into the fixture while the second and third men lower the pan rails into the fixture. The first man then books the barrels and raises the tappet, and the second and third men place end cores into the fixture and close the end cores on the assembly. The three men then return to the assembly of the next core assembly. Two additional men pull the assembled core package to the opposite end of the horizontal assembly table, place a bottom board under the assembled core package, and insert threaded rods to hold the assembled core package together, one man holding the rods while the second man places washers and nuts on the threaded rod and tightens the nuts to hold the core together. These latter two men then lower the assembled and fastened core package onto a storage board, push the transfer carriage back to the other end of the assembly table and push the assembled and fastened core package onto a conveyor means for transfer to storage.

Thus, there is a need for a more accurate and ergonomically acceptable process and apparatus to assemble the core components of an internal combustion engine, and particularly the nine individual components that make up a core package used in the manufacture of an in-line cylinder engine, which weighs about 425 lbs. when assembled.

SUMMARY OF THE INVENTION

The invention provides a new process and apparatus that reduces lifting and eliminates walking with barrel cores weighing 55–64 lbs., eliminates the effort of reaching out with outstretched arms while holding 55–64 lb. cores, and reduces core assembly personnel by up to three people.

The invention provides a core assembly apparatus comprising a rotating table that is rotatable to a plurality of operation positions. A plurality of core assembly fixtures are carried by the rotating table adjacent its periphery, and preferably there is one core assembly fixture for each operation position. Each of the plurality of core assembly fixtures is inclined, with respect to horizontal, toward the central portion of the rotating table, and one of the operation positions comprises means for automatically transferring a completed core assembly from a core assembly fixture to a powered horizontal conveyor.

In one embodiment of the core assembly apparatus, the means for automatically transferring a completed core assembly from a core assembly fixture to a horizontal conveyor comprises a pick-and-place assembly, straddling a powered horizontal conveyor and comprising means for moving a core assembly engagement means horizontally, vertically and angularly for engagement with, and removal of a core assembly from the inclined core assembly fixture of the rotating table and for rotation, lowering and placement of the core assembly on the horizontal conveyor. In another embodiment of the core assembly apparatus, the core assembly fixtures of the rotating table are pivotally attached to the rotating table and include a core assembly gripping mechanism and are driven to pivot the inclined core assembly fixture and lower a completed core assembly onto an adjacent horizontal conveyor.

In the invention, where there are four operation stations, cores to be assembled are brought directly to the first operation station of a rotating table where the cores are removed from the delivery conveyor using zero gravity core handlers, and are placed in their predetermined locations in the core assembly fixture. The assembled cores are then carried by the rotating table to a second operation station where the assembled cores are booked together. The assembled, booked cores are then carried by the rotating table to a third operation station by the rotating table where the assembled and booked cores are bolted together in a completed core assembly. After the assembled, booked cores are fastened together at the third operation station, they are carried by the rotating table to a fourth operation station where they are automatically transferred from the core assembly fixture to a horizontal container that preferably includes power rollers to transfer the assembled cores to storage.

Other features and advantages of the invention will be apparent to those skilled in the art from the drawings and more detailed description of the currently best known modes of the invention that follow.

BRIEF DESCRIPTION OF THE DRAWING FIGURES

FIG. 2 is a diagram illustrating operations at the first operation station of an embodiment of the invention like that illustrated in FIG. 1;

FIG. 3 is a diagram to illustrate operations at the second operation station of the embodiment of FIGS. 1 and 2, and one means for automatically transferring a completed core assembly from the rotating table to a horizontal conveyor at the fourth operation station of the embodiment of FIGS. 1 and 2;

Figure 1:
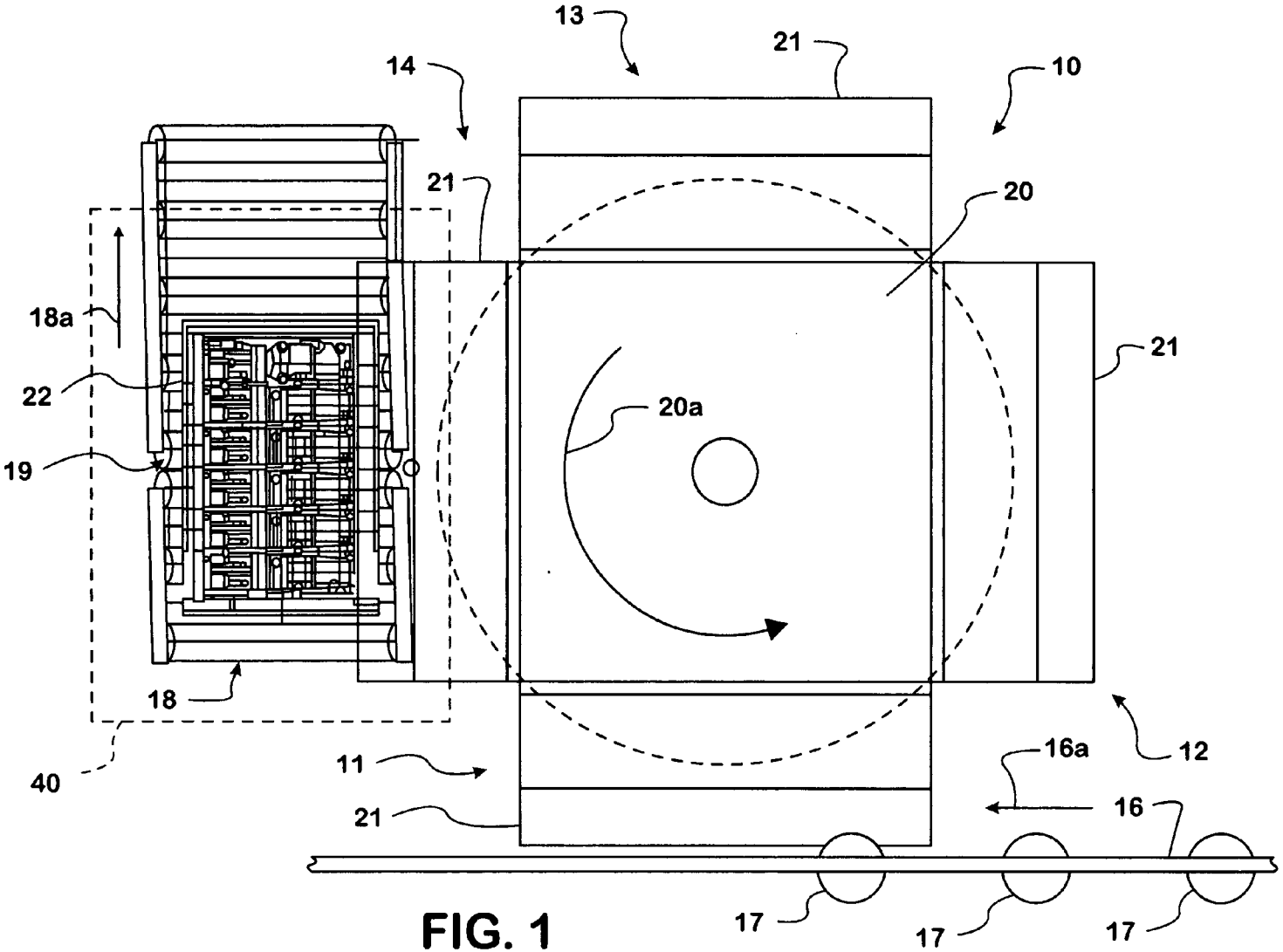
FIG. 1 is a diagram from overhead for illustration of a four-operation station embodiment of the invention.
Figure 6:
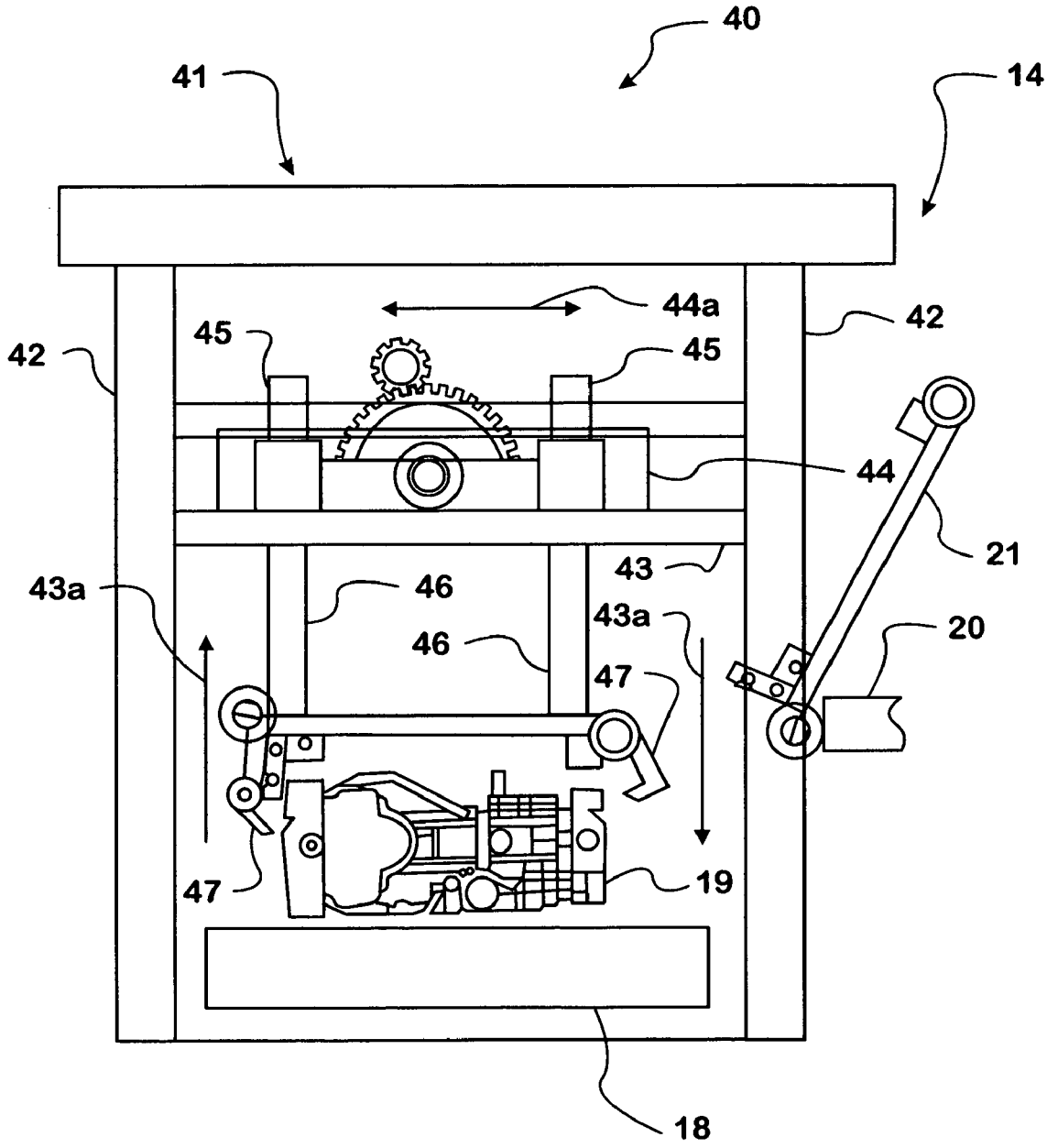
Figure 7A:
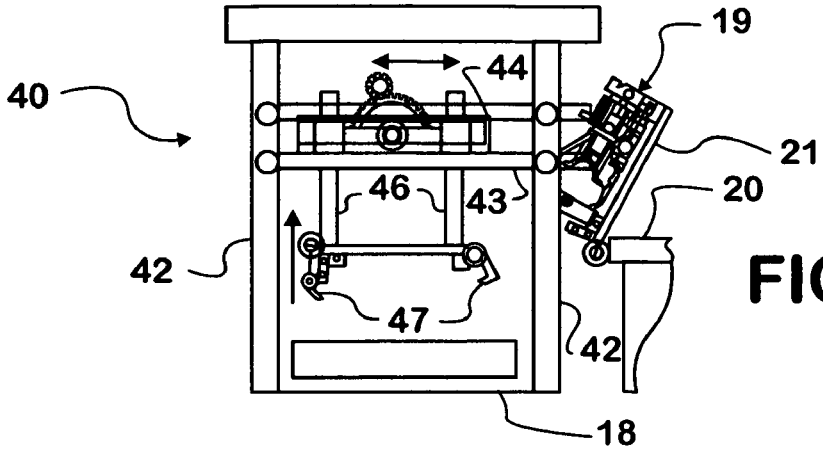
Figure 7B:
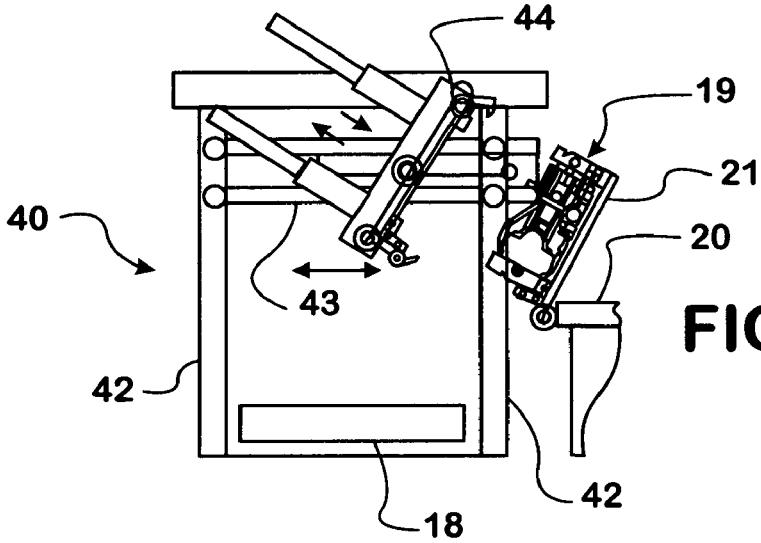
Figure 7C:
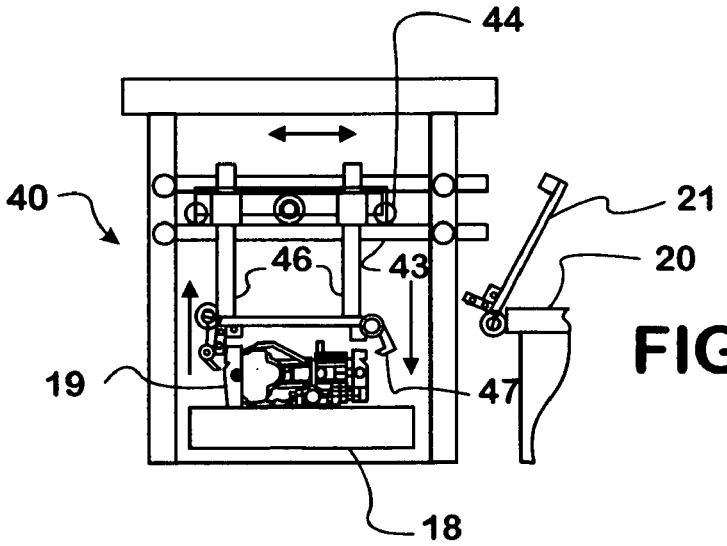

FIG. 6 is a diagrammatic illustration of a preferred pick-and-place apparatus for automatically transferring a completed core assembly from the rotating table to a horizontal conveyor; and FIGS. 7A–7C are diagrams to illustrate the manner in which the pick-and-place apparatus of FIG. 6 transfers a completed core assembly from the rotating table to a horizontal conveyor, for example, at the fourth operation station of FIG. 1.

DETAILED DESCRIPTION OF CURRENTLY BEST-KNOWN MODES OF OPERATION OF THE INVENTION

The embodiments that are illustrated and described below are intended to exemplify and not limit the invention, which may be embodied in systems with fewer or more than four operation stations, and may include other core assembly holders for the cores being assembled and other operations than those illustrated and described below.

FIG. 1 is a diagrammatic illustration from above of a system 10 of the invention with four operation stations to assist in explaining how the rotating table, four operation stations and the input and output conveyors may be related. The details of the core assembly fixtures of the rotating table and the means for transferring completed core assemblies from the rotating table to the horizontal conveyor have been omitted from FIG. 1.

As illustrated by FIG. 1, the systems of the invention include a rotating table 20 that is provided with a first operation station 11, a second operation station 12, a third operation station 13 and a fourth operation station 14. The rotating table 20 and the four operation stations 11–14 comprise the core assembly apparatus 10. The core assembly apparatus 10 is positioned adjacent an overhead conveyor 16 for carrying cores 17 to be assembled to the core assembly apparatus 10. Operation stations one, two and three may be provided with hand-operated switches so the personnel at the three stations may operate them to indicate when they have completed their operations to enable rotation of the table, and the automatic transfer means at the fourth operation station may automatically generate a rotation enabling signal so the rotating table automatically rotates when the operations at all four stations are completed. In an alternative embodiment, the rotating table may be programmed to rotate after a pre-selected time. As further illustrated by FIG. 1, the core assembly apparatus 10 is also positioned adjacent a horizontal conveyor 18 for carrying completed core assemblies 19 for further processing or storage.

During operation, cores to be assembled 17 are carried by the overhead conveyor 16 from right to left, as illustrated by the arrow 16*a*. As further described below, cores 17 are removed from the overhead conveyor 16 at the first operation station 11 and placed in a core assembly fixture 21 that is adjacent the first operation station 11. (See FIG. 2). Upon completion of operations at the four stations or after a predetermined period, the rotating table 20 rotates counter-clockwise through 90 degrees, carrying the cores that have been located at the core assembly fixture 21 at station 11 to the second operation station 12. The second operation station 12 permits workers access to the cores carried by the core assembly fixture 21 for further operations and/or to position further cores on the core assembly fixture 21. (See FIG. 3 at the right). For example, in one embodiment for the assembly of cores for a six-cylinder engine, tappet and end cores may be loaded into core assembly fixture 21 at the first operation station 11, and six barrel cores may be loaded into the core assembly fixture 21 with the tappet and end cores at the second operation station 12. At the same time that the barrel cores are loaded into the core assembly fixture 21 at the second operation station 12, further tappet and end cores to be assembled are being removed from the overhead conveyor 16 and placed in the following core assembly fixture 21 at the first operation station 11.

Upon completion of the processing operations at the first operation station 11 and the second operation station 12, or after a predetermined time, the rotating table 20 again rotates counter-clockwise through 90 degrees, as illustrated by arrow 20*a*, carrying the assembled cores from the second operation station 12 to the third operation station 13, and the cores assembled on the core assembly fixture at first operation station 11 to the second operation station 12. When the assembled and further processed cores on the core assembly fixture 21 reach the third operation station 13, they can again undergo further assembly operations (not shown in the FIGS.). For example, in said one embodiment for the assembly of cores for a six-cylinder engine, the cores can be bolted together at the third operation station 13 by an operator who places two threaded rods through the booked cores and uses a torque wrench to tighten two nuts, one at each end of each rod. At the same time the operations are being conducted at the third operation station 13, they are simultaneously being conducted at the second operation station 12 and the first operation station 11. After operations have been completed at the first operation station 11, the second operation station 12 and the third operation station 13, or after a predetermined time, the rotating table 20 again rotates 90 degrees counter-clockwise, as illustrated by arrow 20*a*, carrying a completed core assembly 19 from the third operation station 13 to the fourth operation station 14, at which the completed core assembly is automatically transferred from the rotating table 20 to storage pallets and/or to a horizontal conveyor 18 (see FIG. 3 at the left), which can carry the completed core assemblies in the direction indicated by arrow 18*a* for further processing or storage. A preferable horizontal conveyor 18 comprises powered rollers, which engage storage pallets 22 on which completed core assemblies 19 are placed.

As further illustrated and described below, the means for automatically transferring a completed core assembly from the core assembly fixtures 21 of the rotating table 20 to a horizontal conveyor 18 can be built into the rotating table 20, or can comprise a pick-and-place assembly 40 located adjacent the fourth operation station 14, as illustrated by the dashed line box 40 of FIG. 1.

In the embodiments further illustrated by FIGS. 2–5, the means for automatically transferring a completed core assembly from the core assembly fixture to the horizontal conveyor are built into the rotating table 20. As best seen in FIGS. 2 and 3, the rotating table 20 can be provided with a plurality of core assembly fixtures 21 that are inclined toward the central portion of the rotating table 20, preferably at an angle of about 60 degrees, permitting cores 17 to be easily removed from the overhead conveyor 16 and manipulated and located on the core assembly fixture 21 at the first operation station, as illustrated in FIG. 2, and to permit further cores to be located on, and the cores present on the core assembly fixture 21 to be further processed, at the second operation station 12, as illustrated at the right of FIG. 3 (and at the third operation station 13, which is not shown in the drawings).

Figure 4:
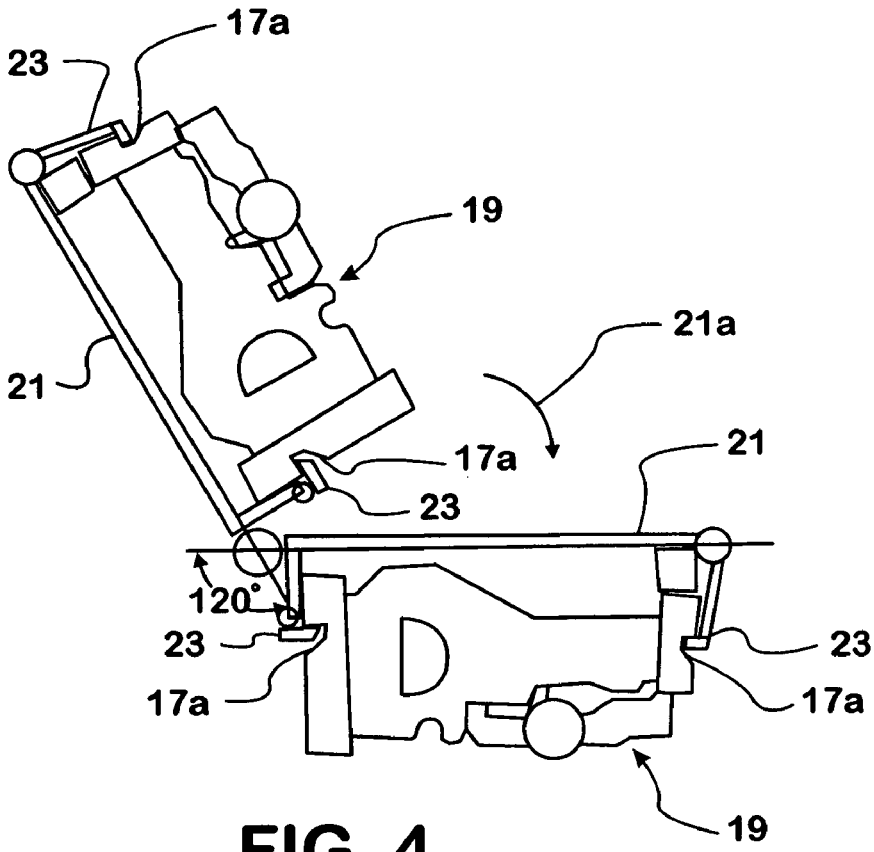
FIG. 4 is a diagram to illustrate the travel of a completed core assembly at the fourth operation station of the embodiment of FIGS. 1–3, provided by the automatic transfer means of FIG. 3.
Figure 5:
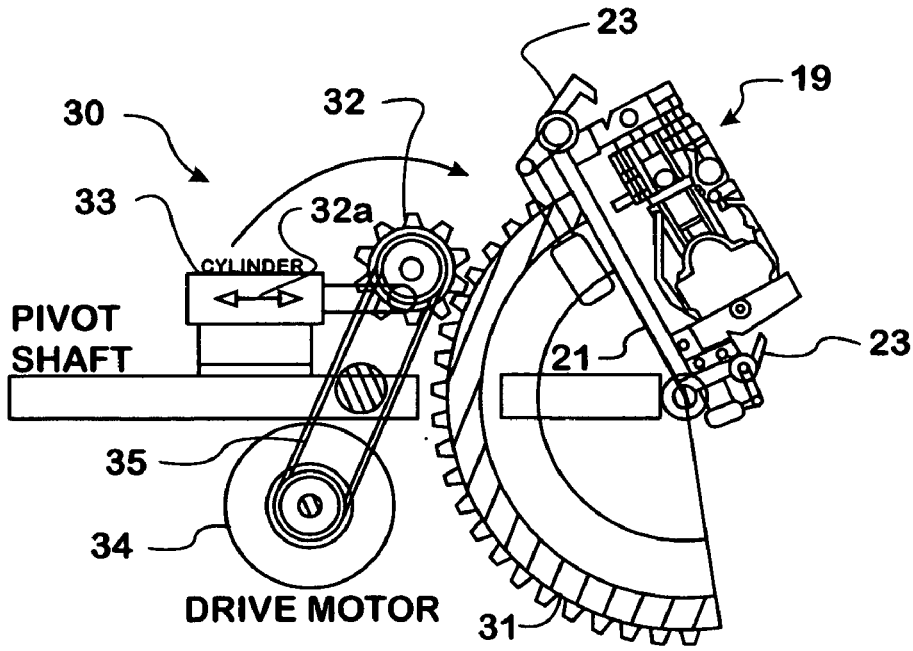
FIG. 5 is a partial drawing of an apparatus of the invention, illustrating the mechanism carried by the rotating table to effect the movement of the completed core assemblies illustrated in FIG. 4, and illustrated in FIG. 3 at the fourth operation station, for transfer of completed core assemblies from the rotating table to a horizontal conveyor.

In one embodiment of a core assembly apparatus of the invention, the plurality of core assemblies 21 carried by the rotating table 20 are pivotally attached adjacent the periphery of the rotating table, as illustrated in FIGS. 2–5, and the core assembly fixtures 21 are provided with plural core assembly engagement means 23, which operate to engage corresponding cavities 17*a* provided in the cores 17 to hold the cores onto the core assembly fixtures 21 as they are transferred from the rotating table 20 to the horizontal conveyor 18 at the fourth operation station 14, as illustrated at the left of FIG. 3. The core assembly engagement means 23 may be hook-like members that are driven from engagement to disengagement positions by pneumatic or hydraulic cylinders, as illustrated in FIG. 5. In operation, when assembly of cores on the core assembly fixtures 21 is completed, the core assembly engagement means 23 are operated to engage the cavities 17*a* in the cores 17 so the cores will not fall from the core assembly fixtures 21.

As illustrated in FIG. 4, the core assembly engagement means 23 are held in the cavities 17*a* of the completed core assemblies 19 and as the completed core assemblies 19 are lowered from the inclined position to the horizontal position by the core assembly fixture 21, as indicated by the arrow 21*a*, the engagement of the core assembly engagement means 23 with the cavities 17*a* of the completed core assemblies 19 prevent the completed core assemblies from falling from the core assembly fixture 21.

FIG. 5 illustrates one embodiment of a mechanism 30 carried by the rotating table 20 for effecting the transfer of completed core assemblies 19 from the rotating table 20 to the horizontal conveyor 18, as illustrated by FIGS. 3 and 4. As illustrated in FIG. 5, the core assembly fixture 21 has attached to it a semi-circular gear 31, which is driven by spur gear 32. The spur gear 32 is held in a disengaged position when the corresponding core assembly fixture 21 is at the first, second and third operation stations and is driven transversely in the direction of arrow 32*a* to the engaged position illustrated in FIG. 5 at the fourth operation station 14, for example, by an hydraulic cylinder 33. When the spur gear 23 has been moved to the position where it engages the semi-circular gear 31 by the hydraulic cylinder 33, it is driven by a drive motor 34 through a drive belt 35. As illustrated in FIG. 5, the drive motor 34 will drive the spur gear 32 in a counter-clockwise direction and through engagement of the spur gear 32 with the semi-circular gear 31, will move the completed core assembly 19 in the direction indicated by the arrow 21*a* of FIG. 4.

While FIG. 5 illustrates a gear-driven mechanism 30 for moving the completed core assembly 19 through 120 degrees in its transfer to a horizontal conveyor, those skilled in the art will recognize that other drive means may be used to accomplish this task.

FIG. 6 illustrates, diagrammatically, another and preferred means for automatically transferring completed core assemblies from the core assembly fixtures of a rotating table to a horizontal conveyor. The means 40 illustrated in FIG. 6 is a pick-and-place apparatus located adjacent the fourth station 14 of the system, as indicated by the dashed line box 40 of FIG. 1. As illustrated by FIG. 6, the pick-and-place assembly 40 comprises a gantry 41 including a plurality of vertical supports 42 straddling the horizontal conveyor 18 upon which completed core assemblies 19 are to be placed. A framework 43 is carried by the vertical supports 42 and is moveable up and down vertically, as indicated by the arrows 43*a*. The pick-and-place assembly includes a first means for driving framework 43 vertically with respect to vertical supports 42. A truck 44 is carried by the framework 43. The truck 44 is carried in such a manner that it is movable both horizontally, toward and away from the rotating table 20 as illustrated by the arrow 44*a*, and pivotally within the pick-and-place assembly. The pick-and-place assembly includes both a second means for driving the truck horizontally with respect to the framework 43 and a third means for pivoting the truck angularly with respect to the framework 43. A plurality of piston/cylinder units 45 are also carried by the truck with their cylinders fixed to the truck and their pistons 46 extendable away from and retractable toward the truck 44. The distal ends of the pistons 46 of the piston/cylinder units 45 carry core assembly engagement means 47. The pistons 46 of the piston/cylinder units 45 are driven by a fourth means for extending and retracting the pistons 46 and the core assembly engagement means 47 away from and toward the truck 44. A fifth means is provided for operation of the core assembly engagement means.

In one preferred embodiment of the invention, the first, second, third and fifth means may be hydraulically driven piston/cylinder units, that are operated by the fourth means for operation of the plurality of piston/cylinder units 45; however, other forms of drive means, such as motorized rack and pinion drives, may be used as will be apparent to those skilled in the art. The selected positions for the ends of travel of the core assembly fixture, framework, truck and pistons of the disclosed apparatus may be fixed by adjustable limit switches, mechanical stops or limits of travel of the various drive means, as is also apparent to those skilled in the art.

The pick-and-place assembly also includes sixth means for control for its operation, as described below and illustrated in FIGS. 7A–7C As indicated by FIG. 7A, in its operation after a completed core assembly has been transferred to the horizontal conveyor 18, framework 43 is driven vertically to a pick-up position, as illustrated in FIG. 7B, and the pistons 46 are retracted within their cylinders. The truck 44 is then driven horizontally toward the rotating table 20 to a core removal position, and is pivoted until the core assembly engagement means 47 are approximately parallel with the inclined core assembly fixtures 21 (in the case of the preferred embodiment it is rotated through about 60 degrees, to match the 60 degree incline of the core assembly fixtures 21). From this position, the pistons 46 of the plurality of piston/cylinder units 45 are then extended to position the core assembly engagement means 47 at their distal ends adjacent the completed core assembly 19 carried by the core assembly fixtures 21 for engagement with completed core assembly 17, as illustrated by FIG. 7B, and the core assembly engagement means 47 are operated to engage the completed core assembly 19.

Upon engagement with the completed core assembly 19, the plurality of pistons 46 are retracted, removing the completed core assembly 19 from the core assembly fixture 21. The truck 44 is then moved horizontally away from the rotating table 20 and is pivoted to position the completed core assembly 19 horizontally within the vertical supports 42 and above the horizontal conveyor 18. The framework 43 is then lowered and the pistons 46 are extended to place the completed core assembly 19 on the horizontal conveyor 18, and the core assembly engagement means 47 are operated to release the core assembly on the horizontal conveyor 18.

Thus, the sixth control means of the pick-and-place assembly a) operates a first means to drive the framework 43 vertically up and down, b) operates a second means to move the truck 44 toward and away from the rotating table 20, c) operates a third means to pivot the truck 44 angularly between a first position where the core engagement means 47 are substantially parallel with a completed core assembly 19 for engagement with the completed core assembly and a second position where a completed core assembly is held substantially horizontal, d) operates a fourth means to extend and retract a plurality of pistons 46 of a plurality of piston/cylinder units 45, to position an engagement assembly means 47 adjacent a completed core assembly 19 carried by the core assembly fixture 21 and lift the completed core assembly 19 from a core assembly holder 21 and lower it onto the horizontal conveyor, and, e) operates a fifth means so a core assembly engagement means of the pick-and-place assembly can engage and release a completed core assembly.

Thus, the pistons 46 of the hydraulic cylinders 45 are retracted after engagement of the core assembly engagement means 47, and a completed core assembly 19 is pulled from the core assembly fixture 21 in a direction substantially perpendicular to the core assembly fixture 21. The truck 44 then rolls horizontally away from the rotating table 20 on the framework 43, and the truck 44 is pivoted until the completed core assembly 19 is in the horizontal position within the pick-and-place assembly 40. Then the completed core assembly 19 is lowered to the horizontal conveyor 18 by a combination of the vertical movements of the frame 43 and the extension of the hydraulic pistons 46.

It is therefore intended that the foregoing detailed description be regarded as illustrative rather than limiting, and that it be understood that it is the following claims, including all equivalents, are intended to define the spirit and scope of this invention.

What is claimed is:

1. A core assembly apparatus, comprising:

a rotating table, said table being rotatable to a plurality of operation positions, a plurality of fixtures for assembling cores, the fixtures being disposed adjacent the periphery of the rotating table and operatively associated therewith, one for each operation position, said plurality of fixtures being inclined toward the central portion of the rotating table, one of said operation positions comprising means for automatically transferring a completed core assembly from one of said fixtures to a horizontal conveyor.

2. The core assembly apparatus of claim 1, wherein said means for automatically transferring a completed core assembly to a horizontal conveyor comprises a transfer mechanism adjacent said one operation position including a plurality of vertical supports straddling said horizontal conveyor;

a framework movably carried by the plurality of vertical supports and drivable toward and away from the rotating table, a truck movably carried by said framework and drivable both horizontally along said framework between said supports and pivotally with respect to said supports, a plurality of hydraulic piston/cylinder units with their cylinders being carried by said truck with their pistons extendible below said truck, the pistons of said plurality of piston/cylinder units carrying a core assembly gripping mechanism at their distal ends and being extendible outwardly from and retractable inwardly toward said truck, wherein upon arrival of a completed core assembly at said one operation position, (a) said framework is driven vertically toward the top of said supports, (b) said pistons are retracted, raising said core assembly gripping mechanism, (c) said truck is driven toward said rotating table and is pivoted so the core assembly gripping mechanism is inclined at the same angle as the completed core assembly, (d) said pistons of said plurality of piston/cylinder units are extended so the core assembly gripping mechanism is in position for engagement with the completed core assembly, (e) said core assembly gripping mechanism is operated to engage the completed core assembly, (f) said pistons of said plurality of piston/cylinder units are retracted to lift said completed core assembly from the core assembly fixture of the rotating table, (g) said truck is driven away from the rotating table while carrying the completed core assembly, and is pivoted so the completed core assembly is horizontally oriented, (h) said framework is driven downwardly and the pistons of the plurality of piston/cylinder units are extended to place the completed core assembly on the horizontal conveyor, and (i) the core assembly gripping mechanism is operated for disengagement of the core assembly gripping mechanism from the completed core assembly.

3. The core assembly apparatus of claim 1 wherein said core assembly fixtures are pivotally attached to the rotating table and include core assembly gripping means, and wherein said core assembly fixtures at each of the operation positions include means engageable with said core assembly fixture at said one operation station and drivable to pivot the core assembly fixture and lower said completed core assembly onto said horizontal conveyor for disengagement of the core assembly gripping means.

4. The core assembly apparatus of claim 3 wherein each of the core assembly fixtures is connected with a semicircular gear, and said means engageable with said core assembly fixtures comprises a spur gear transversely movable between a first position disengaged from said semicircular gear and a second position engaged with said semicircular gear, said spur gear being drivable by a motor and belt drive in said second position to pivot the core assembly fixture and lower said completed core assembly into said horizontal conveyor.

5. A pick-and-place apparatus for removal of an assembled core package from a core assembly fixture, comprising a gantry including a plurality of vertical supports straddling a conveyor onto which assembled core packages are to be placed, a framework that is carried by said vertical supports and movable vertically between said vertical supports, first means for driving said framework vertically with respect to said vertical supports, a truck that is carried by said framework and is movable both horizontally and pivotally on said framework, second means for driving said truck horizontally with respect to said framework, and third means for pivoting said truck with respect to said framework, a plurality of piston/cylinder units carried by said truck with their cylinders fixed to said truck with their pistons being extendible from and retractable within their cylinders, a core package engagement means carried at the distal ends of said pistons, fourth means for extending and retracting the pistons of the plurality of piston/cylinder units in and out of their cylinders, fifth means for operating said core assembly engagement means, and sixth means for operating said pick-and-place assembly by (a) operating said first means to drive the framework vertically, (b) operating said fourth means to retract said plurality of pistons within their cylinders, (c) operating said second means to move the truck toward an adjacent core package and operating said third means to pivot the truck until the core package engagement means is angled for engagement with the adjacent core package, (d) operating said fourth means to extend said pistons of the plurality of piston/cylinder units to position said core assembly engagement means for engagement with the adjacent core package, (e) operating said fifth means so said core package engagement means engages the adjacent core package, (f) operating said fourth means to retract said pistons of the plurality of piston/cylinder units and to carry said core package within said core vertical supports, (g) operating said second means to move the truck away from the core assembly fixture and operating said third means to pivot the truck and place the core package in a horizontal position, (h) operating the first means and fourth means to move the framework, the pistons of the plurality of piston/cylinder units, the core package engagement means and the engaged core package downwardly to place the core package on the horizontal conveyor, and (i) operating the core package engagement means to disengage the pick-and-place assembly from the core package on the horizontal conveyor.

6. A core assembly apparatus, comprising a rotating table, said table being rotatable to a plurality of operation positions, a plurality of fixtures for assembling cores, the fixtures being carried by and disposed adjacent the periphery of the rotating table, one for each operation position, said plurality of fixtures being inclined toward the central portion of the rotating table, and a pick-and-place assembly adjacent one of said operation positions comprising means for moving a core engagement means horizontally, pivotally, and vertically for engagement with a completed core assembly and transfer of the completed core assembly from one of said fixtures to a horizontal conveyor.

7. The core assembly apparatus of claim 6, wherein said pick-and-place assembly comprises a plurality of vertical supports straddling said horizontal conveyor;

a framework movably carried by the plurality of vertical supports and drivable toward and away from the rotating table, a truck movably carried by said framework and drivable both horizontally along said framework between said supports and pivotally with respect to said supports, a plurality of hydraulic piston/cylinder units with their cylinders being carried by said truck with their pistons extendible below said truck, the pistons of said plurality of piston/cylinder units carrying a core assembly gripping mechanism at their distal ends and being extendible outwardly from and retractable inwardly toward said truck, wherein upon arrival of a completed core assembly at said one operation position, (a) said framework is driven vertically toward the top of said supports, (b) said pistons are retracted, raising said core assembly gripping mechanism, (c) said truck is driven toward said rotating table and is pivoted so the core assembly gripping mechanism is inclined at the same angle as the completed core assembly, (d) said pistons of said plurality of piston/cylinder units are extended so the core assembly gripping mechanism is in position for engagement with the completed core assembly, (e) said core assembly gripping mechanism is operated to engage the completed core assembly, (f) said pistons of said plurality of piston/cylinder units are retracted to lift said completed core assembly from the core assembly fixture of the rotating table, (g) said truck is driven away from the rotating table while carrying the completed core assembly, and is pivoted so the completed core assembly is horizontally oriented, (h) said framework is driven downwardly and the pistons of the plurality of piston/cylinder units are extended to place the completed core assembly on the horizontal conveyor, and (i) the core assembly gripping mechanism is operated for disengagement of the core assembly gripping mechanism from the completed core assembly.

8. A core assembly apparatus, comprising a rotating table, said table being rotatable to a plurality of operation positions, a plurality of fixtures for assembling cores, the fixtures being carried by and disposed adjacent the periphery of the rotating table, one for each operation position, said plurality of fixtures being upwardly inwardly inclined toward the central portion of the rotating table, and means for engaging a completed core assembly and automatically moving the completed core assembly angularly and pivotally from a position on said inclined core assembly fixture to a horizontal conveyor.

9. The core assembly apparatus of claim 8, wherein said means comprises a plurality of vertical supports straddling said horizontal conveyor;

a framework movably carried by the plurality of vertical supports and drivable toward and away from the rotating table, a truck movably carried by said framework and drivable both horizontally along said framework between said supports and pivotally with respect to said supports, a plurality of hydraulic piston/cylinder units with their cylinders being carried by said truck with their pistons extendible below said truck, the pistons of said plurality of piston/cylinder units carrying a core assembly gripping mechanism at their distal ends and being extendible outwardly from and retractable inwardly toward said truck, wherein upon arrival of a completed core assembly at said one operation position, (a) said framework is driven vertically toward the top of said supports, (b) said pistons are retracted, raising said core assembly gripping mechanism, (c) said truck is driven toward said rotating table and is pivoted so the core assembly gripping mechanism is inclined at the same angle as the completed core assembly, (d) said pistons of said plurality of piston/cylinder units are extended so the core assembly gripping mechanism is in position for engagement with the completed core assembly, (e) said core assembly gripping mechanism is operated to engage the completed core assembly, (f) said pistons of said plurality of piston/cylinder units are retracted to lift said completed core assembly from the core assembly fixture of the rotating table, (g) said truck is driven away from the rotating table while carrying the completed core assembly, and is pivoted so the completed core assembly is horizontally oriented, (h) said framework is driven downwardly and the pistons of the plurality of piston/cylinder units are extended to place the completed core assembly on the horizontal conveyor, and (i) the core assembly gripping mechanism is operated for disengagement of the core assembly gripping mechanism from the completed core assembly.

10. The core assembly apparatus of claim 8 wherein said means comprises core assembly fixtures that are pivotally attached to the rotating table and include core assembly gripping means, and wherein said core assembly fixtures at each of the operation positions includes means engageable with said core assembly fixture at said one operation station and drivable to pivot the core assembly fixture and lower said completed core assembly onto said horizontal conveyor for disengagement of the core assembly gripping means.

* * * * *